United States Patent [19]

Ulin

[11] 4,309,705

[45] Jan. 5, 1982

[54] CHAFF EJECTING DEVICE

[75] Inventor: Carl O. Ulin, Järfälla, Sweden

[73] Assignee: U.S. Philips Corporation, New York, N.Y.

[21] Appl. No.: 103,326

[22] Filed: Dec. 14, 1979

[30] Foreign Application Priority Data

Dec. 14, 1978 [SE] Sweden ..... 7812889

[51] Int. Cl.[3] ..... H04K 3/00

[52] U.S. Cl. ..... 343/18 E; 102/505; 273/317

[58] Field of Search ..... 102/89 CD; 343/18 E

[56] References Cited

U.S. PATENT DOCUMENTS 3,027,047 3/1962 Johnson ..... 102/89 CD X
3,898,661 8/1975 Kelly et al. ..... 343/18 E
3,987,966 10/1976 Ruda et al. ..... 343/18 E X
4,134,115 1/1979 Ström ..... 343/18 E X

*Primary Examiner*—Malcolm F. Hubler
*Attorney, Agent, or Firm*—Thomas A. Briody; David R. Treacy; Robert J. Kraus

[57] ABSTRACT

A device for ejecting radar interference chaff, comprising a magazine having a number of tubular cells (21) in which bundles of chaff (22) are displaced towards an ejection opening. A plunger device (23) and a wire (29) connected thereto is used for displacing the bundles. The wire runs inside the covers of said bundles between the plunger device and the ejection opening and is used to rip the covers when the bundles pass said opening. Said magazine may comprise one or a number of changeable cassettes, each having a number of said cells.

7 Claims, 6 Drawing Figures

CHAFF EJECTING DEVICE

BACKGROUND OF THE INVENTION

The invention is directed to a device for ejecting radar chaff. The device comprises an elongate magazine having a number of longitudinal, tubular cells containing bundles of chaff which are displaced in the direction of the ejection end of the magazine by displacement means. Means are provided at the ejection end for detaching the chaff from said bundles by opening an enclosing cover thereof. In the following the word chaff will be used throughout as a designation of the radar interference means used and should be interpreted so as to cover the usual foil chaff as well as similar means e.g. metalized glass fibers.

Devices of this type are known and are used for spreading chaff clouds from airplanes. Said devices are usually mounted at the underside of an airplane wing. A chaff cloud of this type normally comprises a very great number of chaff of different lengths, forming dipoles of corresponding lengths. The chaff cloud will, depending on the lengths of the dipoles, interfere with frequency bands which are used for radar reconnaissance, homing missiles and corresponding objects.

SUMMARY OF THE INVENTION

One object of the invention is to provide a device of the above-mentioned type for displacing said chaff bundles and detaching the chaff by the use of means which have low weight and low manufacturing cost to.

The object of the invention is obtained by providing a device which includes in each tubular cell, a plunger device movable in the longitudinal direction of the cell. A wire, or thread, of which one end is attached to said plunger device and which runs from said plunger device out through the ejection opening of the cell, is also provided. Said wire, or thread, runs between said plunger device and said ejection opening, inside the cover of each bundle in said cell. Said plunger device is movable within said cell towards said ejection opening for displacing the bundles. The plunger device is moved by means of a pulling force acting upon said wire by a driving means included in the device. The cover of each of said bundles is ripped by said wire or thread, when the same is removed, as the chaff bundles pass by the ejection opening.

Thus the invention provides a simple means for both displacing and cutting said bundles.

A further embodiment of the inventive device is characterized in that said wire, at the ejection opening, runs over a pulley or a corresponding means, and from this point along the outside of the cell wall back to a driven pulley or the equivalent provided at the opposite end of the cell. The pulling force is applied to the wire by rotating said driven pulley.

In practice, the time for loading a chaff ejecting device may determine the take off time of an airplane carrying the chaff. One further object of the invention is to provide a magazine of a construction which simplifies said loading and allows the loading time to be minimized. Said object of the invention is obtained by a device of the above-mentioned type which is characterized in that the magazine comprises a number of removable cassettes each of which contains a number of tubular cells. The driving means for each cell is provided at one end of the respective cassette. The magazine further comprises a locating space at the corresponding end of each cassette. Each cassette locating space contains drive elements which are positioned so as to be engaged when a cassette is introduced into said space. By the use of changable cassettes which may be loaded beforehand, the loading time of the magazine may be minimized substantially.

According to a further embodiment, one end of each cassette carries a driven pulley for each of its cells. It also carries common drive elements, preferably gear wheels, for the transfer of a rotational movement to said driven pulleys. The corresponding end of the cassette locating space of the magazine comprises a drive element connected to said motor driving means which is in engagement with said common drive elements after the cassette has been introduced.

In another embodiment the wire is arranged in a closed loop with the other end of said wire being connected to said plunger device via a spring element, e.g. a coil spring.

Advantageously each driven pulley is provided with three flanges arranged so as to form two separate traces for winding up and winding off, respectively, a length of said wire which corresponds to the moving distance of the plunger device, said wire being extended through an opening in the intermediate one of said flanges.

A chaff bundle for use in an ejection device of the type described above and being provided with an enclosing cover is characterized according to the invention in that said bundle comprises at the inside of said cover a longitudinal recess into which said wire, or thread, may be introduced. The part of said recess facing said chaff may be separated therefrom, e.g. by means of two interleaved, longitudinal flaps of the same material as said cover.

DESCRIPTION OF THE PREFERRED EMBODIMENTS

Figure 1A:
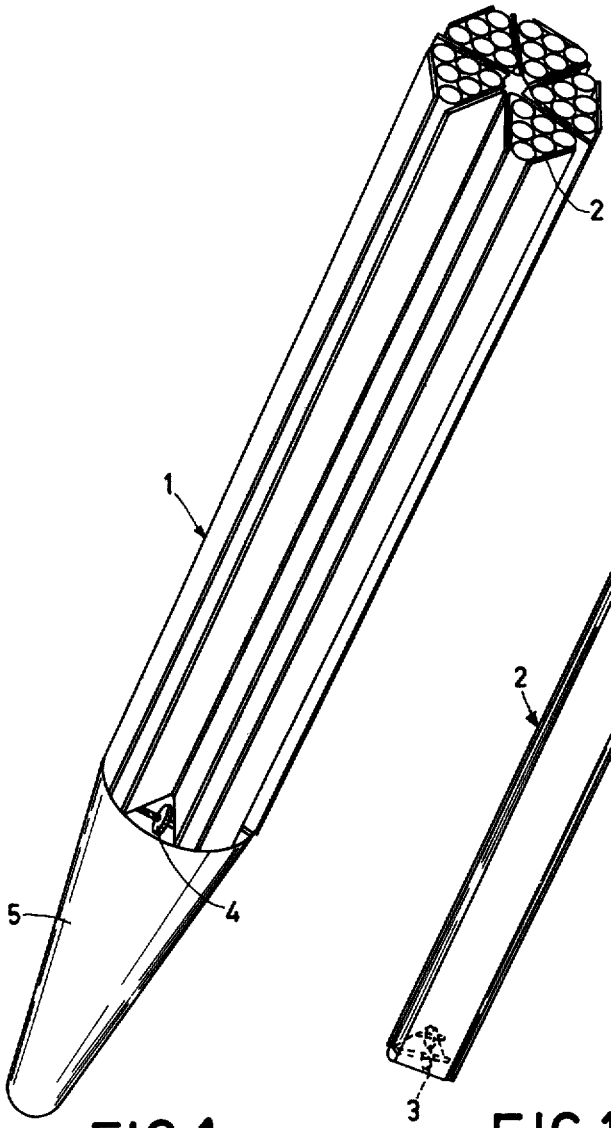
FIGS. 1*a* and 1*b* show schematically a perspective view of a device according to the invention together with a cassette thereof.
Figure 1B:
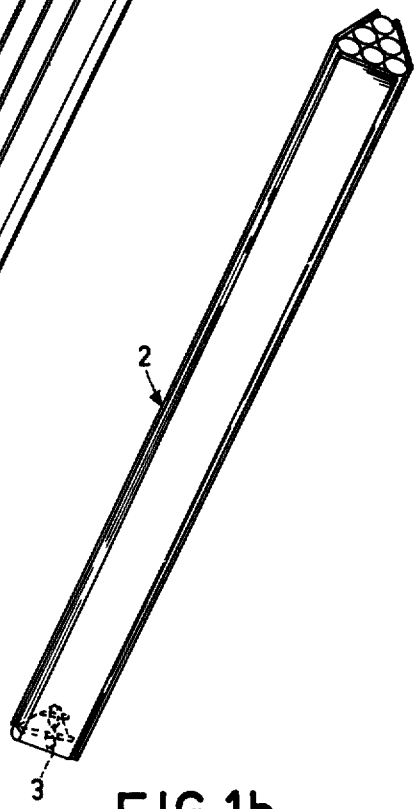

FIG. 1*a* shows schematically a device for the ejection of radar chaff according to the invention. The device comprises a magazine 1 for six cassettes 2, of which one is shown outside said magazine in FIG. 1*b*. Said cassettes each comprise six tubular, longitudinal cells. The tubular cells are so arranged that said cassettes have a cross-section which corresponds to an equilateral triangle. One end of each of said cassettes 2 comprises two engaged driving gears 3. Said gears 3 are intended for driving the bundle displacement device according to the invention, the design of which is evident from FIGS. 2 and 3. When the cassette 2 is introduced into a respective locating space in the magazine 1 either one of said gears 3 is made to engage an associated gear wheel 4 provided in the nose portion 5 of the magazine. Moreover, said portion 5 comprises at least one controllable motor for driving the gear wheels 4 and thereby said gear 3 of each cassette. The cassette 2 is intended to be introduced sidewise into the magazine 1. When the cassette has been introduced it may be fixed by means of quick coupling means of a type which is known to one skilled in the art. In a modified embodiment of the magazine 1 it may comprise a fully enveloping, circular cylindrical cover, into which said cassettes may be introduced in the longitudinal direction of the magazine, from the ejection end thereof. When separate driving motors are used for each of the cassettes, said motors may be activated selectively and as a consequence thereof chaff may be ejected from selected cassettes. If said cassettes are loaded with chaff of different lengths a chaff cloud having desired frequency interference characteristics can be formed.

Figure 2:
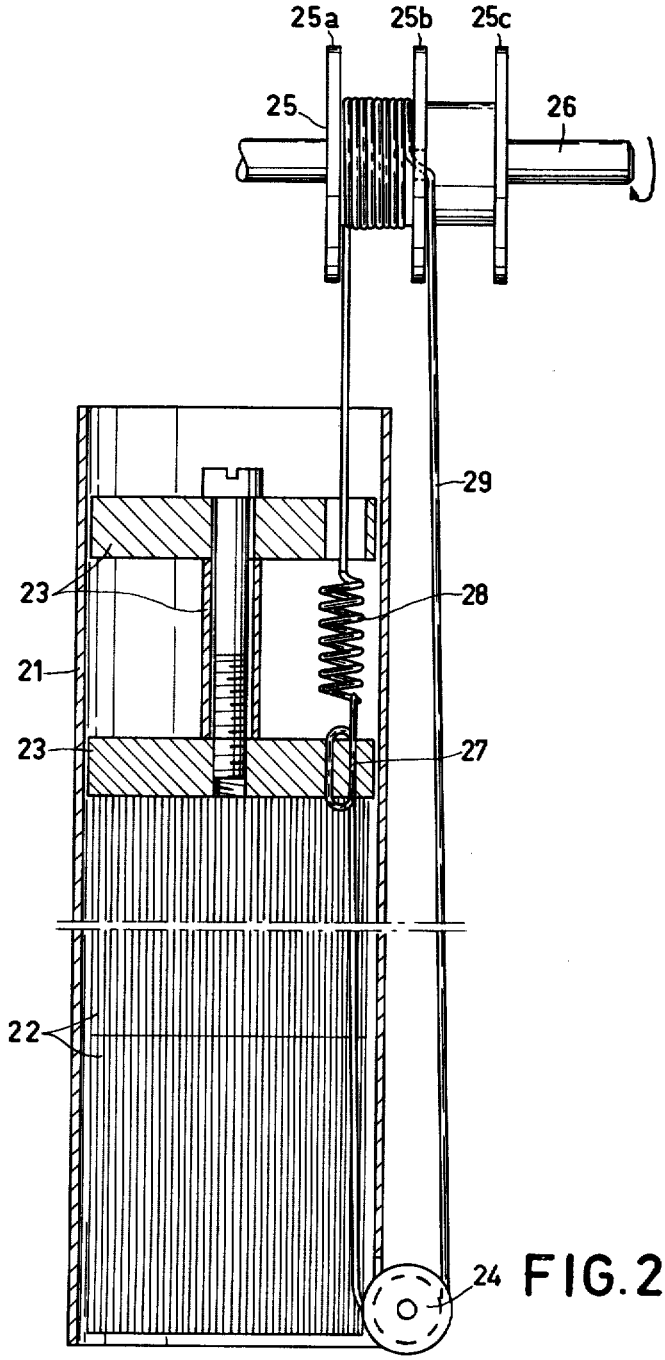
FIG. 2 shows one embodiment of the displacement and ripping device which is provided at each cell.

In FIG. 2 is shown a partly sectional view of a tubular cell and the associated means for displacing and ripping the chaff bundles. The cell comprises a tube 21, having a circular cylindrical shape, into which a number of chaff bundles 22 have been inserted. Adjacent to the chaff bundles is a plunger device 23 which may be displaced inside said tube 21. At the ejection end of the tube a pulley 24 is provided in a slot of the tube wall. At the opposite end of the tube is provided a driven pulley 25 carried by a shaft 26, which, during displacement of the chaff bundles in said tube is rotated by a driving motor (not shown) in the direction indicated by an arrow. A wire or thread 29 runs over said pulley 24 and said driven pulley 25. One end of said wire is fixedly connected to the plunger device 23 by means of a connecting element 27. Between said connecting element 27 and said pulley 24 the wire runs inside the cover of each bundle. The other end of said wire is engaged with the connecting element via a coil spring 28 intended to tension the wire adequately in its path over said pulley 24 and said driven pulley 25. As shown in the drawing said driven pulley 25 comprises three flanges 25*a*, 25*b*, and 25*c*. A length of said wire, to be wound off during the displacement movement, is wound between the outer flange 25*a* and the central flange 25*b*. The wire is extended through the central flange to the space which is bounded by the outer flange 25*c*, in which space a corresponding length of said wire is wound when said plunger moves.

As illustrated in the drawing, the plunger device 23 of this embodiment comprises two cylindrical plates interconnected by a screw element. Obviously this plunger device may be realized in many alternative ways. However, it is essential in the illustrated embodiment that the length of the plunger device in the longitudinal direction of the tube is adequate to prevent the plunger from being inclined by driving force received from the wire 29, which is applied to only one side of the plunger device.

During ejection of the chaff, the apparatus disclosed in FIG. 2 operates as follows. Shaft 26 and thereby the driven pulley 25 is rotated in the direction indicated. Then a pulling force is generated in the wire 29 which, via said pulley 24, acts on the plunger device 23 in the direction of the ejection opening of the tube 21. Because the wire 29 runs inside the covers of the respective bundles 22, said covers will be cut or ripped by the wire when passing by the pulley 24 and thereby the chaff contained therein will be made free and ejected at the ejection opening.

Figure 3:
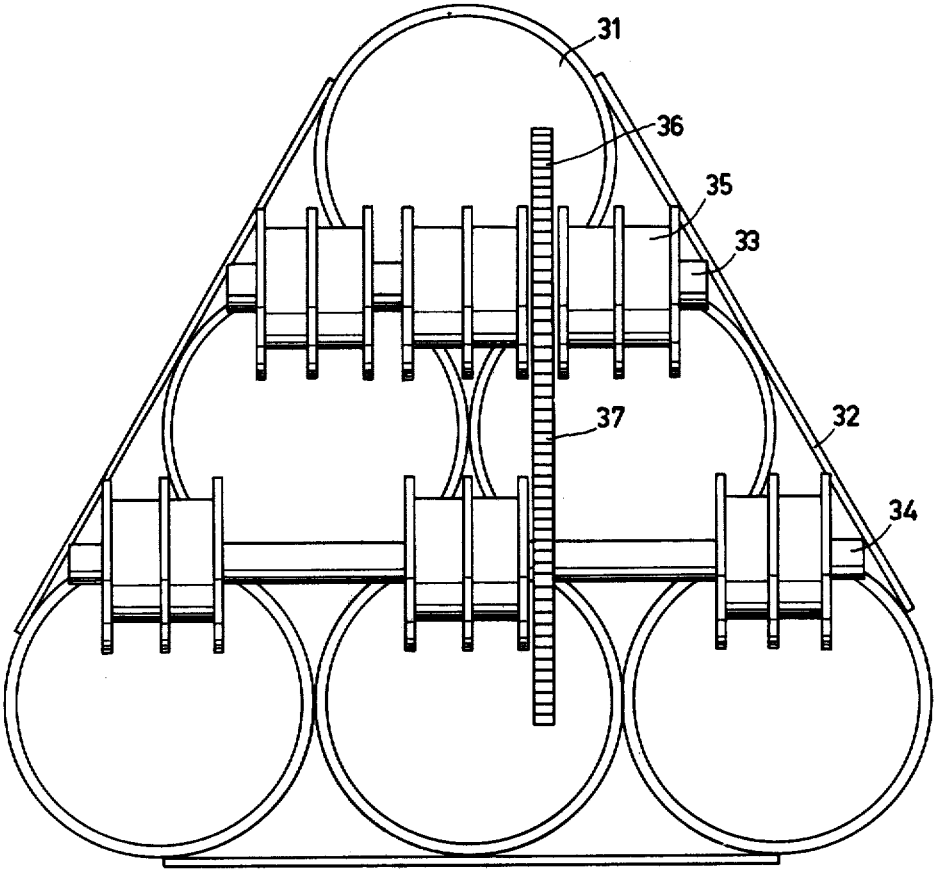
FIG. 3 shows an end view of a cassette intended to be used in a device according to the invention and carrying driving means for driving the wires thereof.

FIG. 3 shows an end view of a cassette intended for use in an ejection device according to the invention. As is evident from the drawing, this cassette comprises six tubular cells 31, said cells being interconnected by welds or by means of wall elements like 32, so that the cassette forms a self-supporting unit, for handling purposes. FIG. 3 also shows the driving elements arranged on this cassette. These elements comprise two parallel shafts 33 and 34, each of which carries three driven pulleys 35 for the wires of the respective tubular cells. The shafts 33 and 34 are engaged via gears 36 and 37, respectively. One gear, e.g. gear 36, may be brought into engagement with a corresponding gear 4 provided in the magazine (see FIG. 1) when the cassette is introduced. The wire 29 for each tubular cell (see FIG. 2) runs through the space between the cells. The pulleys 24 are also disposed in said spaces.

The cassette illustrated in FIG. 3 may, if desirable, be enclosed in a fully enclosing cover corresponding to the wall element 32. If so, this cover should be of such a length that it will also enclose the driving means 33–37 shown in FIG. 3. Thereby the outside of the cassette will be essentially flat, except for attachement means necessary for connecting the cassette to the magazine, and this will simplify the handling of the cassette.

Figure 4A:
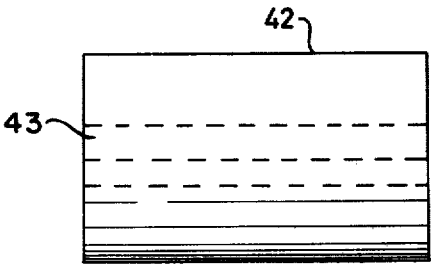
FIGS. 4*a* and 4*b* show a chaff bundle according to the invention.
Figure 4B:
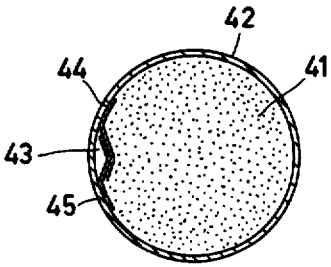

FIGS. 4*a* and 4*b* show side and sectional views, respectively, of a chaff bundle constructed in accordance with the invention. As is evident from the sectional view, this bundle comprises chaff 41 contained by a cover 42. A longitudinal recess 43, into which said wire or thread may be inserted, is provided inside the cover. Said recess is separated from the chaff by means of two interleaved, longitudinal flaps 44, 45.

When ripping the covers of said bundles, the ripping force from the wire acts transversely to the side wall of the cell. Consequently, only the frictional forces appearing at the walls of said cell must be overcome during displacement of the bundles, and therefore the covers will not be loaded significantly in the longitudinal direction of the bundles. This allows for the use of simplified bundle covers.

I claim:

1. A chaff-ejecting device, including:

A. an elongate magazine having a plurality of longitudinal, tubular cells containing bundles of the chaff;

B. displacement means for displacing the bundles in the direction of an ejection end of each cell;

C. means provided at the ejection ends of the cells for freeing the chaff from the bundles by opening an enclosing cover thereof;

said device being characterized in that the means for displacing the bundles and freeing the chaff comprises, for each cell:

D. a plunger device movable longitudinally within the cell;

E. a wire having one end attached to the plunger device and running inside the enclosing cover of each bundle in the cell, from said plunger device out through the ejection end of the cell; and F. driving means for applying a force to the wire and moving the plunger device toward the ejection end, thereby displacing the bundles contained in the cell;

said wire successively ripping open the covers of the bundles as they successively pass by the ejection end of the cell.

2. A chaff-ejecting device as in claim 1, characterized in that each wire runs over guide means at the ejection end of each cell, and then runs along the outside of the cell to the driving means.

3. A chaff-ejecting device as in claim 1, characterized in that the magazine comprises:

A. a first portion comprising a plurality of removable cassettes, each including:

1. a plurality of the tubular cells, and
2. the driving means for each cell, located at one end of the cell; and B. a second portion including a plurality of drive elements for supplying power to the driving means;

said drive elements being positioned so as to engage said driving means when said first and second portions of the magazine are mated.

4. A chaff-ejecting device as in claim 3, characterized in that the driving means for the cells of each cassette comprise:

A. a driven pulley for each cell; and

B. common drive elements for the transfer of rotational movement to the driven pulleys;

said common drive elements for the cassettes engaging with the drive elements of the magazine's second portion when the first and second portions are mated.

5. A chaff-ejecting device as in claim 1, 2, 3 or 4, characterized in that the wire is arranged in a closed loop and is returned to the plunger device via a spring element.

6. A chaff-ejecting device as in claim 1, 2, 3, or 4, characterized in that the driving means for each cell comprises a driven pulley having three flanges which collectively form two separate traces for winding and unwinding, respectively, a length of the wire corresponding to the distance moved by the plunger device, said wire passing through an opening in the flange separating the two traces.

7. A chaff-ejecting device as in claim 1, 2, 3 or 4, characterized in that the enclosing cover for each bundle of chaff has a shape corresponding to that of the tubular cell in which it is contained, said cover including an internal, longitudinal recess into which the wire for the respective cell is inserted.

* * * * *